US010335009B2

(12) United States Patent
Hexem

(10) Patent No.: US 10,335,009 B2
(45) **Date of Patent: *Jul. 2, 2019**

(54) DISHWASHER WITH PERMANENT STORAGE COMPARTMENT

(71) Applicant: Carol Hexem, St. Louis, MO (US)

(72) Inventor: Carol Hexem, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/583,525

(22) Filed: May 1, 2017

(65) Prior Publication Data

US 2017/0231460 A1 Aug. 17, 2017

Related U.S. Application Data

(60) Continuation of application No. 15/243,383, filed on Aug. 22, 2016, now Pat. No. 9,655,493, which is a division of application No. 14/328,590, filed on Jul. 10, 2014, now Pat. No. 9,445,707, which is a continuation-in-part of application No. 13/939,158, filed on Jul. 10, 2013, now abandoned.

(60) Provisional application No. 61/670,126, filed on Jul. 11, 2012, provisional application No. 61/844,846, filed on Jul. 10, 2013.

(51) Int. Cl.

| | |
|---|---|
| ***A47L 15/00*** | (2006.01) |
| ***A47L 15/24*** | (2006.01) |
| ***A47L 15/42*** | (2006.01) |
| ***A47L 15/50*** | (2006.01) |

(52) U.S. Cl.

CPC ..... *A47L 15/0097* (2013.01); *A47L 15/247* (2013.01); *A47L 15/248* (2013.01); *A47L 15/4246* (2013.01); *A47L 15/4248* (2013.01); *A47L 15/506* (2013.01); *A47L 15/507* (2013.01)

(58) Field of Classification Search

CPC .. A47L 15/0097; A47L 15/247; A47L 15/248; A47L 15/4246; A47L 15/4248; A47L 15/506; A47L 15/507

USPC ..... 134/56 D, 57 D, 58 D, 133

See application file for complete search history.

(56) References Cited

U.S. PATENT DOCUMENTS

| | | | | |
|---|---|---|---|---|
| 2006/0180179 | A1 | 8/2006 | Roderer et al. | |
| 2007/0125403 | A1 | 6/2007 | Ecker et al. | |
| 2007/0267402 | A1* | 11/2007 | Harned | F24C 15/006 219/392 |
| 2008/0029131 | A1 | 2/2008 | Ecker | |
| 2008/0210272 | A1 | 9/2008 | Kazcmarek | |
| 2011/0180118 | A1* | 7/2011 | Schrott | A47L 15/0055 134/56 D |

* cited by examiner

*Primary Examiner* — Levon J Shahinian

(74) *Attorney, Agent, or Firm* — Lewis Rice LLC

(57) ABSTRACT

A dishwasher, including a chamber for washing dishes and a chamber for storing dishes is provided. A mechanism is also provided allowing the dish racks to move the dishes from the washing chamber to the storage chamber of the dishwasher once the wash is completed.

13 Claims, 17 Drawing Sheets

DISHWASHER WITH PERMANENT STORAGE COMPARTMENT

CROSS REFERENCE TO RELATED APPLICATION(S)

This application is a Continuation of U.S. Utility patent application Ser. No. 15/243,383 filed Aug. 22, 2016, which is Divisional of U.S. Utility patent application Ser. No. 14/328,590 filed Jul. 10, 2014 and now patented as U.S. Pat. No. 9,445,707, which in turn is a Continuation-In-Part of U.S. Utility patent application Ser. No. 13/939,158, filed Jul. 10, 2013 and now abandoned, which in turn claims the benefit of U.S. Provisional Patent Application Ser. No. 61/670,126, filed Jul. 11, 2012. U.S. Utility patent application Ser. No. 14/328,590 also claims the benefit of U.S. Provisional Application Ser. No. 61/844,846 filed Jul. 10, 2013. The entire disclosure of all the above documents is herein incorporated by reference.

BACKGROUND OF THE INVENTION

1. Field of the Invention

This disclosure is related to the field of automatic dishwashers, particularly for those which allow for integral storage of dishes in a separate chamber from where they are washed.

2. Description of the Related Art

There can be little doubt that the invention of the automatic dishwasher has fundamentally changed the way that both individuals, and food service establishments operate. In particular, the ability to simply gather a large number of dirty dishes together, place them in a machine, and allow the machine to wash them while an individual is engaged in another task has resulted in dramatic savings of time and money. No longer is nearly as much time spent physically washing, rinsing, sterilizing, and even drying dishes.

In addition to savings from time and labor, the automatic dishwasher has also revolutionized what can be used to clean dishes. Harsh or abrasive chemicals which previously were known for cleaning power and sterilizing effect, but which could be hazardous or unpleasant to individuals in contact with them can be used in a dishwasher. Further, the ability of dishwashers to control water pressures, temperature, time, and spray angles can produce dishes which are truly cleaner and safer than those washed by hand.

While there can be no doubt the dishwasher is a valuable labor saving device, there are still a couple of places where it creates some additional labor over hand washing. In the first instance, the dishwasher requires hand loading. Traditionally, loading of a dishwasher is accomplished through the use of one or more "racks" which are wire baskets on rollers. The front door of the dishwasher is opened, and each rack is rolled out where it can be accessed, the dishes are then stood in the racks (which often include specialized projections for supporting certain types of dishes at certain angles) and once full the racks are rolled back into the dishwasher's internal washing chamber.

In addition to hand loading, the dishwasher is also hand unloaded. Once the dishes are clean, the door is again opened, the racks are again rolled out, and the dishes are removed and placed in cabinets or in other traditional storage devices and containers. Unloading of a dishwasher is often considered a chore. In the first instance, a traditional dishwasher has to be fully unloaded before any new dirty dishes can be placed within it, otherwise the introduction of dirty dishes will serve to contaminate dishes that are already clean. Thus, the unloading process has to be entirely completed before the loading process can be reinitiated. This means that it is often necessary to store dirty dishes on a countertop or other surface while they are waiting from the dishwasher to be emptied. This is unsightly and can be unsanitary.

Because of the problems with unloading the dishwasher many users treat the dishwasher almost as a specialized "cabinet" in its own right. In effect, particularly for those that live alone, the dishwasher may simply become both the washing apparatus and the storage apparatus. If there are a sufficiently small number of dishes, a user may simply leave the clean dishes in the dishwasher and take them out to use. At the end of the day (or when they have all been used) the dirty dishes are simply returned to the dishwasher and everything is washed again. In this arrangement, there is no storage for clean dishes outside of the dishwasher, but dirty dishes are generally still stored external to the dishwasher.

In commercial settings, the concept of allowing dishes to be cleaned automatically has led to what are essentially conveyor dishwashers. One example of a conveyor dishwasher is described in United States Patent Application Publication 2008/0029131, the entire disclosure of which is herein incorporated by reference. While, these systems provide for an automated conveyance of dishes from a loading step through washing and drying in a linear fashion conveyor fashion, they do not resolve the issue of storage as the dishes. Dishes, after washing are simply deposited out of the dishwasher to await being unloaded. As conveyor dishwashers generally do not use doors, this type of arrangement is totally unsuitable for a residential application and the dishes at the end of the conveyor are not intended to be stored as they are not actually removed from the washing chamber of the dishwasher.

Instead, in a conveyor dishwasher, the dishes still have to be removed and separately stored in order to utilize the dishwasher to wash more dishes and to prevent dishes which have completed the cycle from getting wet from later wash cycles. Further, these type of conveyor systems rely on separation of a single compartment into zones as opposed to separate washing and storage chambers. This means that humidity from washing operations can get at dishes still in the machine making them unsuitable for long term storage and provides for an unsightly arrangement unsuitable for residential use.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a dishwasher which includes at least two chambers. A first chamber is utilized as a washing chamber where dishes are washed in a traditional automatic wash environment. Once washed, the dishes are then automatically transferred to a storage chamber where the clean dishes are available for use. Once transferred, the washing chamber is available to be used for additional washing and dishes in the storage chamber do not need to be transferred to a separate cabinet, but can be used directly.

Described herein, among other things, is a dishwasher comprising: a washing chamber including a washing chamber door; a storage chamber including a storage chamber door; a waterproof barrier separating said washing chamber and said storage chamber; at least one rack including a basket configured to support dishes; and a conveyor mechanism configured to move said rack from said washing chamber to said storage chamber; wherein when said washing chamber door is open said at least one rack can be accessed by a user if said rack is in said washing chamber; and wherein said washing chamber is configured to wash dishes in said at least one rack when said at least one rack is within said washing chamber; wherein, after said dishes have been washed in said washing chamber, said waterproof barrier is automatically opened and said conveyor mechanism automatically moves said at least one rack through said waterproof barrier and into said storage chamber; and wherein when said storage chamber door is open, said at least one rack can be accessed by said user if said rack is in said storage chamber.

In an embodiment, the dishwasher further comprises a pre-wash chamber including a pre-wash chamber door; wherein said at least one rack can be accessed by said user if said rack is in said pre-wash chamber; and wherein said pre-wash chamber is separated from said washing chamber by a waterproof barrier.

In an embodiment of the dishwasher, the pre-wash chamber stores dirty dishes.

In an embodiment of the dishwasher, the storage chamber stores clean dishes.

In an embodiment of the dishwasher, the rack moves, in order, from said pre-wash chamber, to said washing chamber, to said storage chamber.

In an embodiment of the dishwasher, the rack moves, in order, from said pre-wash chamber, to said washing chamber, to said pre-wash chamber; or said rack moves, in order, from said storage chamber, to said washing chamber, to said storage chamber.

In an embodiment of the dishwasher, the waterproof barrier includes a door.

In an embodiment of the dishwasher, the door is articulated.

In an embodiment of the dishwasher, the conveyor mechanism comprises a chain drive.

In an embodiment of the dishwasher, the conveyor mechanism comprises a belt drive.

In an embodiment of the dishwasher, the conveyor mechanism comprises a worm drive.

In an embodiment of the dishwasher, the conveyor mechanism comprises a lever arm.

In an embodiment of the dishwasher, the rack moves in a first direction through said washing chamber door and in a transverse direction through said waterproof barrier.

In an embodiment of the dishwasher, the rack moves in a first direction through said storage chamber door and in a transverse direction through said waterproof barrier.

There is also described herein, a method of washing dishes comprising: providing a dishwasher including: a washing chamber including a washing chamber door; a storage chamber including a storage chamber door; a waterproof barrier separating said washing chamber and said storage chamber; at least one rack including a basket configured to support dishes; and a conveyor mechanism configured to move said rack from said washing chamber to said storage chamber; opening said washing chamber door; moving said at least one rack can out said washing chamber door; loading said at least one rack with dirty dishes; returning said at least one rack to said washing chamber; washing dishes in said washing chamber; automatically opening said waterproof barrier; moving washed dishes from said washing chamber to said storage chamber; closing said waterproof barrier; and accessing said washed dishes from said storage chamber door.

DESCRIPTION OF THE PREFERRED EMBODIMENT(S)

Figure 1:
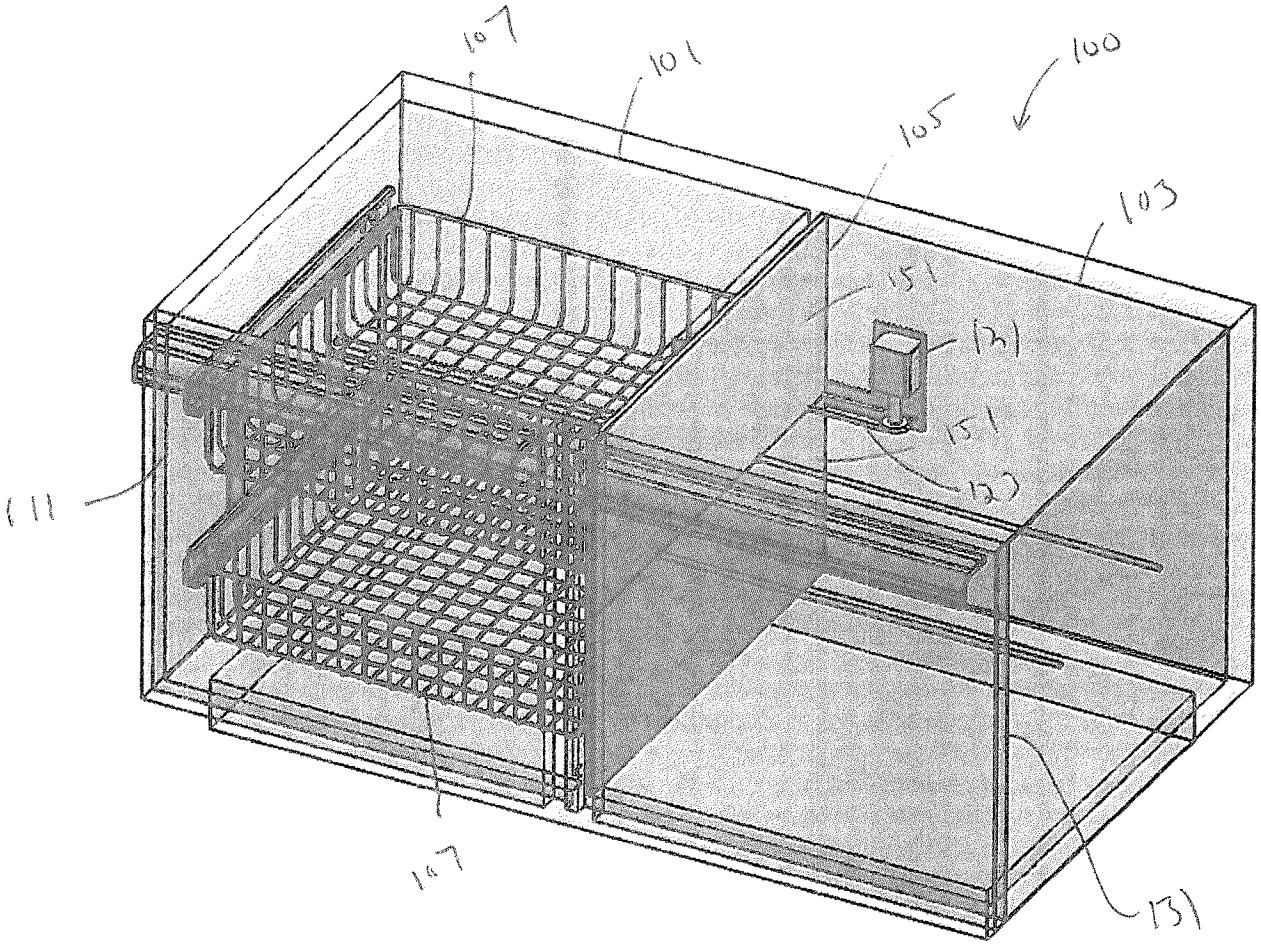
FIG. 1 depicts a perspective view of an embodiment of a two-chamber dishwasher.

There is described herein, among other things, a dishwasher including a chamber for washing dishes and a spate storage chamber for dishes after they have been washed. Generally, the two chambers are separable and can be sealed off from each other. This allows for dishes in the storage chamber to be unaffected by actions taken place in the washing chamber and they are not exposed to humidity or other effects from the washing chamber.

The dishwasher's washing chamber has standard dishwashing mechanisms and may be constructed in accordance with any technology now known or later developed for the automatic washing of dishes. The washing chamber may also be designed to utilize specialized washing processes, such as those specifically designed for washing of glassware, pots and pans, crockery, and related technologies where the dishwasher is not designed or intended to generically wash dishes, but is intended to wash a specialized subset of dishes.

As used herein, the term "dishes" is used openly to refer to any object used in the preparation, serving, handling, and consumption of food and beverage and a "dishwasher" is a device for automatically (e.g. non-manually) washing, sterilizing, and/or drying dishes. While the dishes will generally be used for adult human consumption in a residential setting, this is by no means necessary and dishes includes objects used in commercial settings, utilized for the feeding of animals (such as, but not limited to, dog bowls), or for specialized feeding of infants (such as but not limited to, baby bottles, breast pump parts, and syringes).

Further, while the dishwasher discussed herein is generally intended to be for the washing of food dishes, it should be recognized that a dishwashing apparatus, even if designed to wash consumer or food service dishes, can be used in other environments. Thus, a "dishwasher" as the term is used herein can also be used to clean and/or sterilize "dishes" which are not suitable for human consumption, but which are known to those of ordinary skill in the art as being dishwasher safe. This can include, but is not limited to, scientific apparatus (e.g. beakers, test tubes, and petri dishes) and medical devices (e.g. surgical tools).

While the above definitions are provided to help clarify how these terms are used in this disclosure, it should be recognized that the terms "dishes" and "dishwasher" are terms of common parlance and well understood by those of ordinary skill in the art. Thus, the above definitions are in no way limiting to how one of ordinary skill in the art would interpret them in conjunction with various automated washing technologies.

After the final cycle of the washing cycle is completed in the washing compartment (often a drying cycle) of the dishwashers discussed herein, one side panel which is not the door of the washing chamber will open to allow the washed dishes to automatically be moved into the storage chamber of the device. The storage chamber can be used to replace traditional cabinets used for storing dishes, and eliminate the need to empty the dishes after they are washed. Further, it can increase the throughput of the dishwasher as it can allow for the washing chamber to be washing a set of dishes prior to a previous set having been removed and placed into an external storage apparatus if one was still being used.

FIGS. 1-4 provide a first embodiment of a multi-chamber dishwasher (100) comprising separate chambers for washing and stowing dishes. In this embodiment, the dishwasher (100) comprises a first washing chamber (101) and a second storage chamber (103). The washing chamber (101) is designed so as to be generally watertight and has a forward opening door (111) of the traditional type. The storage chamber (103) may also include a forward opening door (131) but does not need to include watertight seals in most of its connections as the storage chamber (103) does not include a washing apparatus and is not internally designed to be a wet environment. The door (131) may also be designed to appear as a cabinet door or otherwise have different appearance to the door (111). This can allow for the dishwasher (101) to be placed in a residential kitchen environment with it still appearing to be a standard dishwasher of prior design.

The washing chamber (101) and storage chamber (103) are separated from each other by a water-resistant barrier (105) or wall which can be automatically opened to transfer the dishes between the two chambers upon completion of the wash cycle. This barrier (105) may comprise or include one of more doors (151) which are designed to open to allow for racks (107), which are of a type know to those of ordinary skill in the art to support dishes during washing, to be transferred between the washing chamber (101) and the storage chamber (103). The racks (107) will generally be designed to move in two directions. They will first move into and out of the doors (111) and (131) generally by having rolling baskets on confined tracks, and are designed to be moved in a transverse direction to move the racks between the storage chamber (103) and washing chamber (101).

Figure 2:
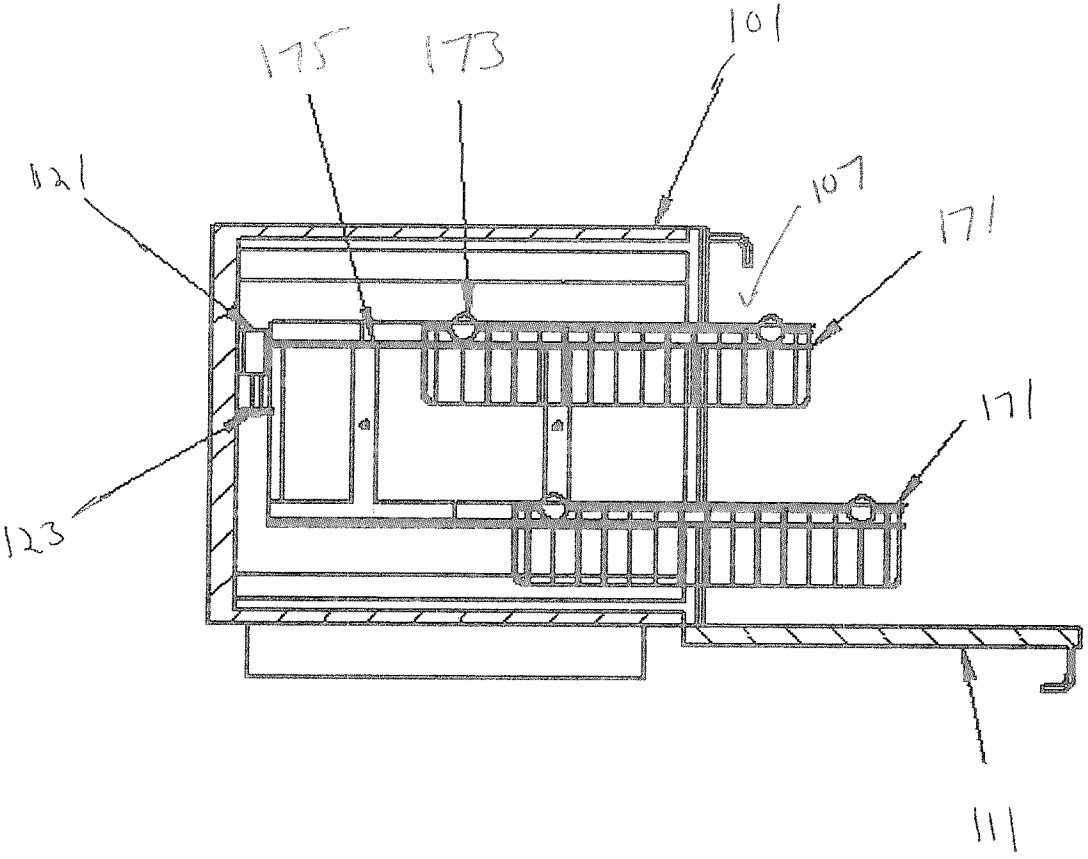
FIG. 2 provides a side view of the dishwasher of FIG. 1 showing how the rack baskets can be loaded and rolled into the washing chamber.

As shown best in FIG. 2, the racks (107) are first designed to move in a first direction generally so that they can be moved into or out of the relevant chamber via door (111) or (131). This is generally accomplished in the same fashion as standard racks (107) operate with a convention dishwasher. The racks (107) comprise some form of wire basket (171) which are mounted on wheels (173) which run on a track (175).

The dishwasher (100) is generally used by opening the door (111) and pulling the racks (107) forward through the opening revealed by opening door (111) as indicated in process in FIG. 2. Dirty dishes are then placed in the basket (171) and the rack (107) is slid back into the chamber (101) and the washing cycle is initiated. In operation, the dishwasher (100) will generally be in the position shown in FIGS. 1 and 4. Once the washing cycle is complete, the racks (107) now are transferred via a separate movement which moves them to the storage chamber. This movement is best shown in process in FIG. 3. As should be apparent, in this depicted embodiment, the movement of the racks between the two chambers (101) and (103) will generally be a direction generally perpendicular or transverse to the movement from the loading to washing position of the racks (107). While this generally perpendicular movement is usually preferred, it is by no means required and instead of the storage chamber (103) being next to the washing chamber (101) as shown in FIGS. 1-4, the storage chamber (103) may be behind, below or above the washing chamber (101) in an alternative environment. The transverse movement is, however, preferred as it allows the dishwasher (100) to be placed in a residential setting with the storage chamber (103) taking up the space of a traditional cabinet and the washing chamber (101) occupying the space of a traditional dishwasher.

Figure 3:
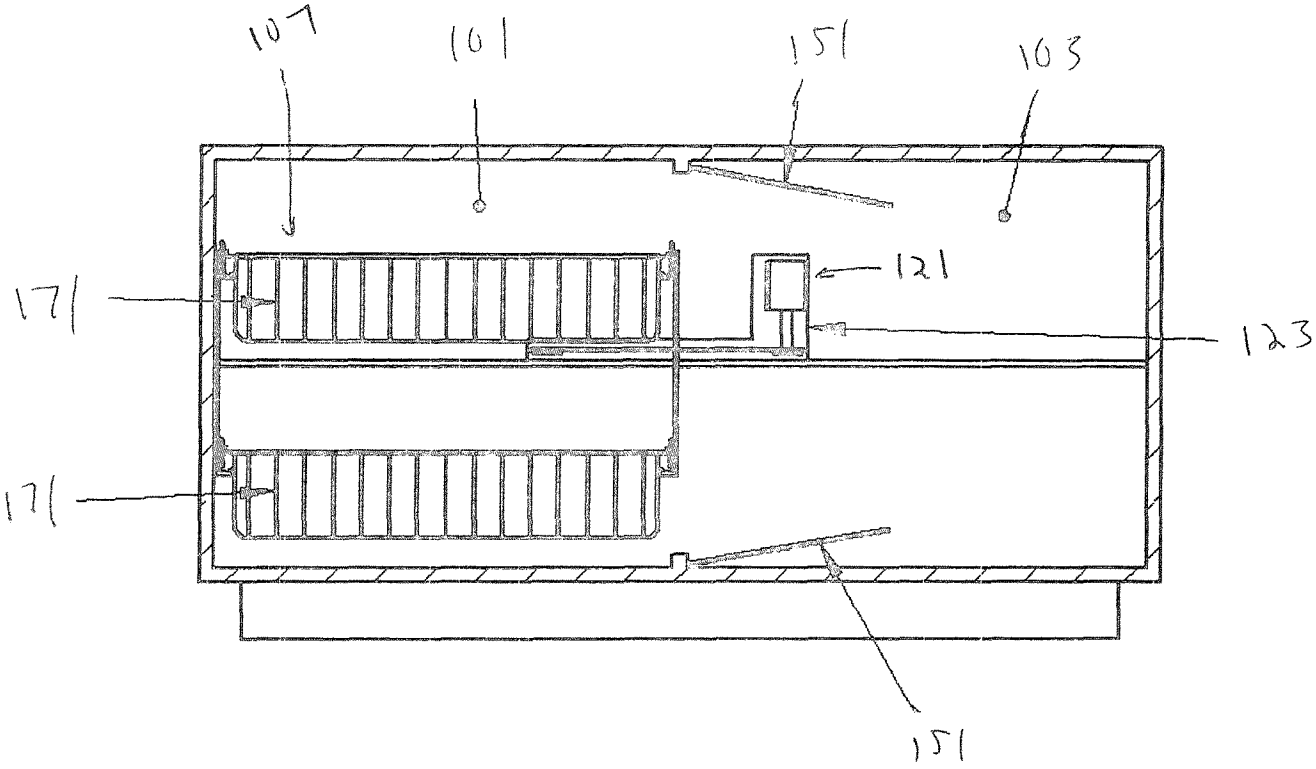
FIG. 3 provides a front view of the dishwasher of FIG. 1 illustrating how the barrier between the washing and storage chamber can be opened to allow for the rack to transversely go from the washing chamber to the storage chamber.
Figure 4:
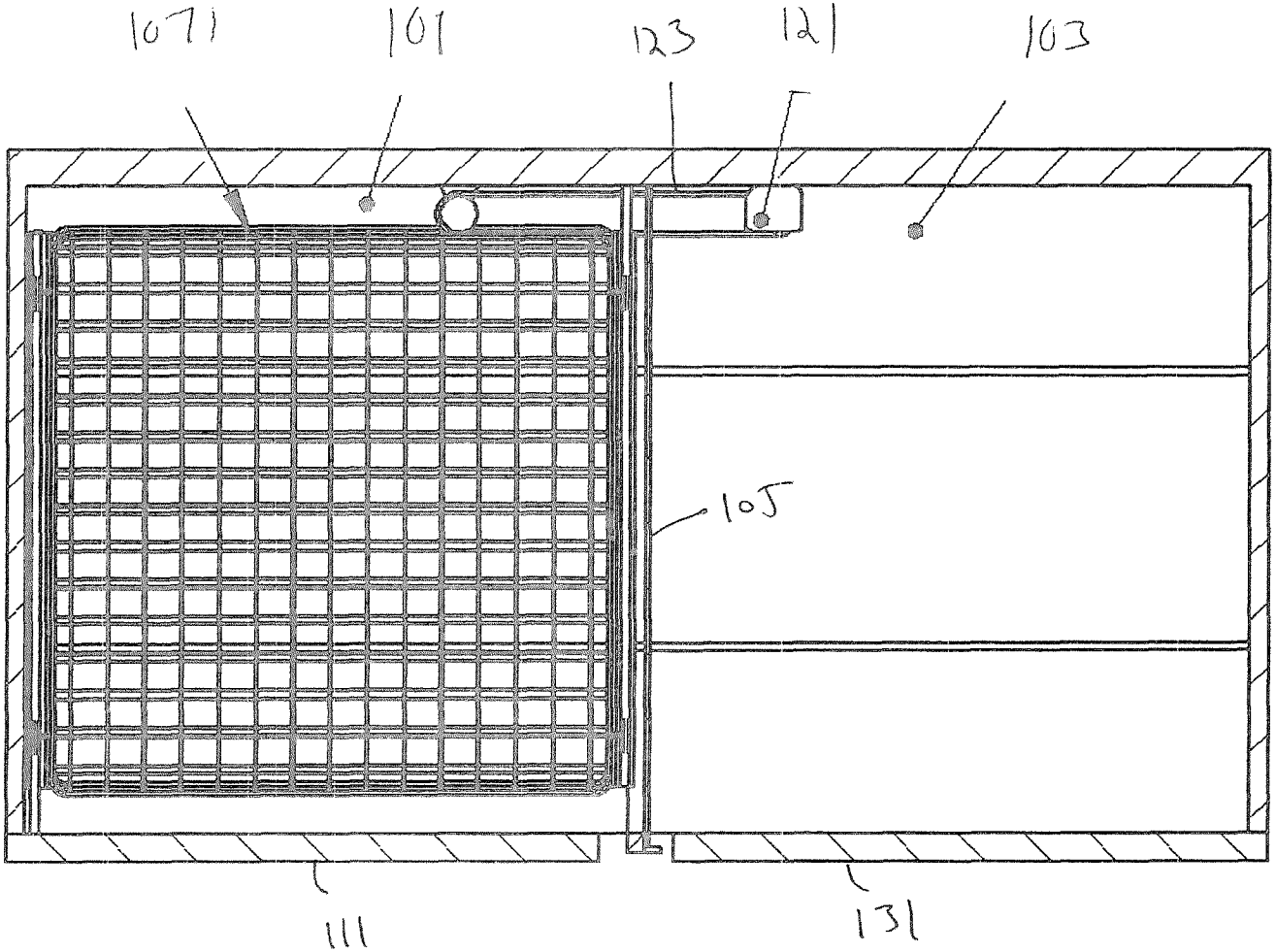
FIG. 4 provides a top view of the arrangement of FIG. 3

As can be best seen in FIG. 3, the racks (107) will generally be moved between the chambers by a motor (121) and conveyor (123). Upon the wash cycle being completed and generally after any significant water has been allowed to exit the washing chamber (101), the doors (151) will open and the conveyor (123) will move the racks (107) to the storage chamber (103). In the storage chamber (103) dishes can remain in the racks (107) until such time as the user requires use of the dishes and they will generally be taken directly from the racks (107) at that time. This storage chamber (103) allows for less work by the user because the dishwasher will not need to be hand emptied once the washing cycle is complete. Instead, dishes are automatically transitioned to storage. Once this has happened, additional racks (107) may be placed into the washing chamber (101)

and a second load of dishes may be washed (which would then remain in the washing chamber (101)) or the system may wait until the racks (107) in the storage chamber are empty (all the dishes have been used) and then the racks (107) may be returned to the washing chamber (101).

As should be apparent in FIGS. 1-4, depending on the embodiment, in order to allow for easier unloading of the dishes from the storage chamber (103), the basket (171) may or may not be moved with supporting structures. It is generally preferred that the entire rack (107) mechanism be moved between the two chambers. In particular, the track mechanisms (175) can be moved between the two chambers (101) and (103). In this way, dishes can be removed from the storage chamber (103) in the inverse manner they were loaded into the washing chamber (101). The door (131) is simply opened, the basket (171) is rolled out on wheels (107) along the track (175) and the dishes are accessible. This allows for a user, particularly in a residential setting, to treat the storage chamber (103) as simply a specialized cabinet.

Figure 5:
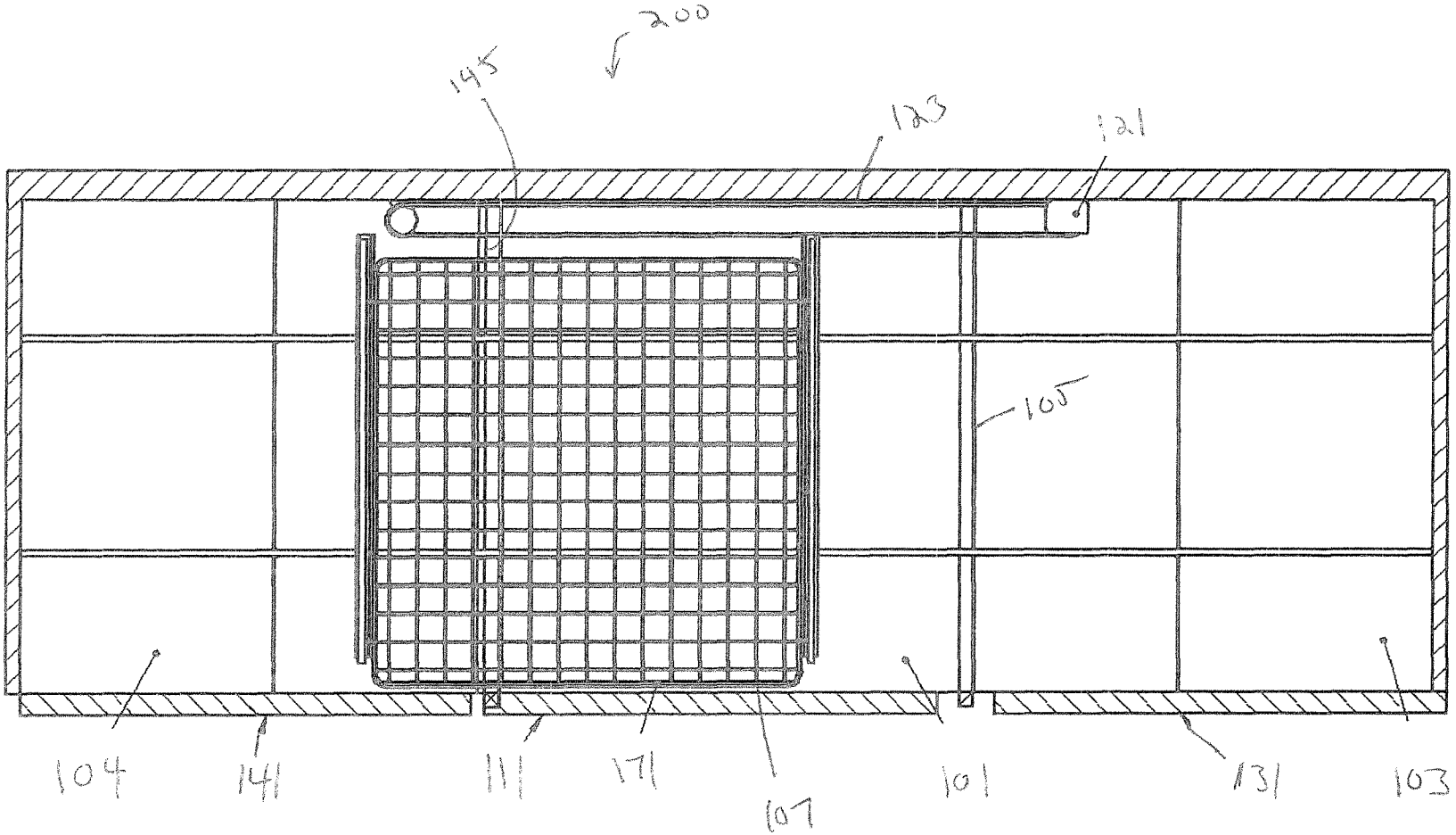
FIG. 5 provides a top view of an embodiment of a three-chamber dishwasher.
Figure 6:
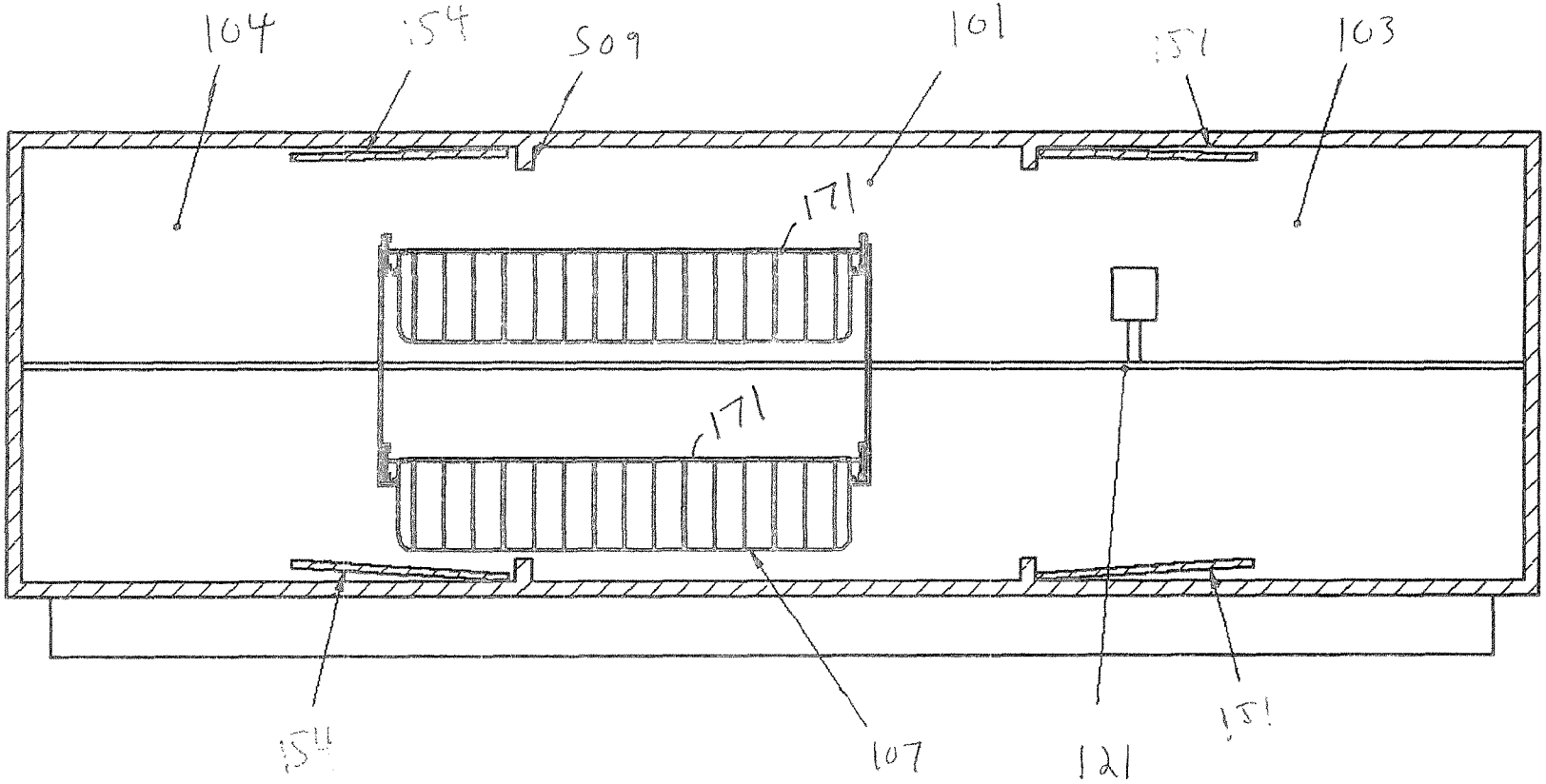
FIG. 6 shows a front view of the embodiment of FIG. 5.

FIGS. 5 and 6 provide for a variation on the embodiment of FIGS. 1-4. In the embodiment of FIGS. 5 and 6, the dishwasher (200) includes a washing chamber (101) and storage chamber (103) generally similar to the embodiment of FIGS. 1-4. However, the embodiment of FIGS. 5 and 6 includes a third pre-wash chamber (104). The pre-wash chamber (104) also includes similar structures to the other chambers such as door (141) and barrier (145) including doors (154). In operation, the user would generally load the dishes and place them into the pre-wash chamber (104). This would allow for loading of the dishwasher (100) while there are racks of dishes being washed in the washing chamber (101). When the washing chamber (101) is available, generally because dishes in the washing chamber (101) have moved to the storage chamber (103), the racks (107) can be moved from the pre-wash chamber (104) to the washing chamber (101). The arrangement of FIGS. 5 and 6 can provide for greater throughput and capacity to the version of FIGS. 1-4. Further, this arrangement could allow for elimination of the door (111) as direct user access to the washing chamber (101) is not required for loading. Further, it can allow for a system where dirty dishes are placed in the pre-wash chamber (104) while clean dishes are being used from the storage chamber (103). In this way dishes never have to be placed in a separate storage apparatus whether clean or dirty. Thus, dishes are always stored out of sight, regardless of the current state of cleanliness.

In an alternative embodiment of the three-chamber dishwasher (200) of FIGS. 5-6, the chambers would consist of one washing chamber (101) and two storage chambers (103) and (104). In this arrangement, the dishes would be loaded into the washing chamber (101), and then selectively conveyed to either of the stowage chambers upon completion of the washing cycle. This would provide for expanded storage to wash capacity. Each storage chamber (103) and (104) would generally have its own external door (131) and (141) which would allow the user to access the dishes from outside the dishwasher (200). In a still further embodiment, each chamber (103) and (104) can be used for both storage and pre-wash purposes allowing the rack (107) to move from the chamber once the rack (107) is full of dirty dishes and back to the same chamber once clean.

In a still further embodiment, the dishwasher can comprise more than three chambers including any number of washing chambers (101), storage chambers (103), and pre-washing chambers (104) in any combination and arrangement. Such an embodiment would generally be similar to one of the three-chamber dishwashers (200) above, simply with more chambers. Any such embodiment would generally contain at least one washing chamber and one storage chamber, with the remainder of the chambers being assigned as either pre-washing chambers, storage chambers, additional washing chambers, or assigned as dual-function chambers where they can have multiple functions of pre-wash, wash, or storage depending on the particular need at the time.

Figure 7:
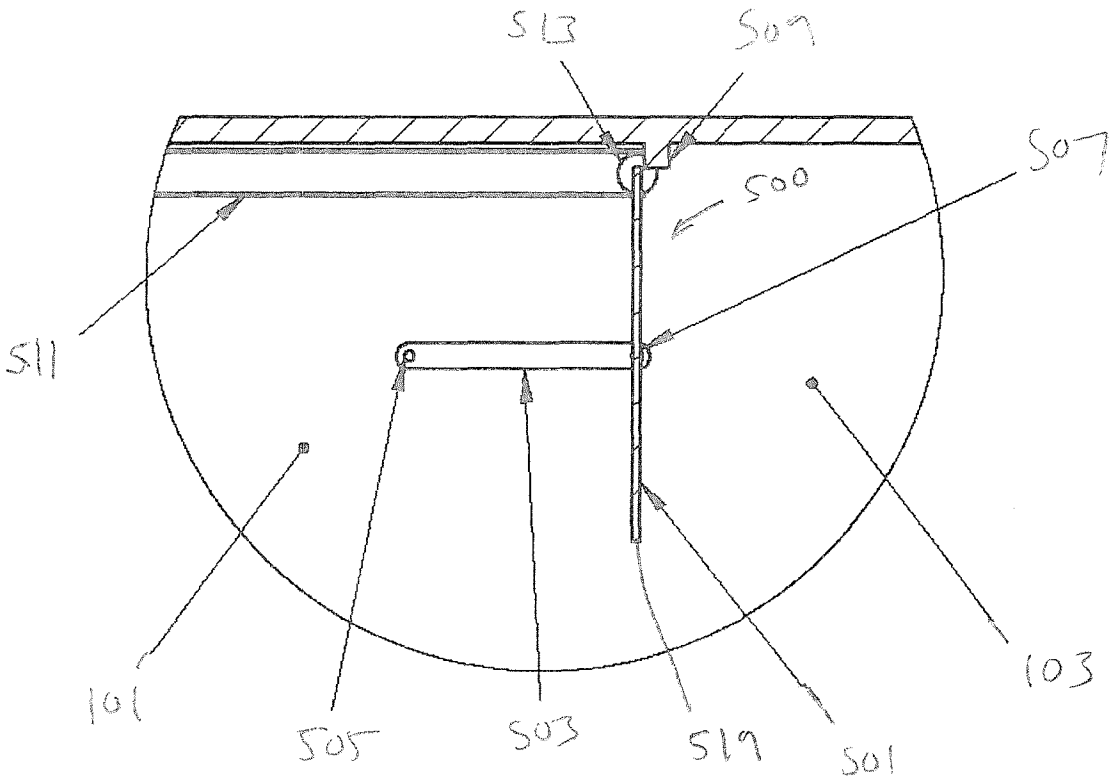
FIG. 7 shows a first embodiment of a barrier system in a closed position.
Figure 8:
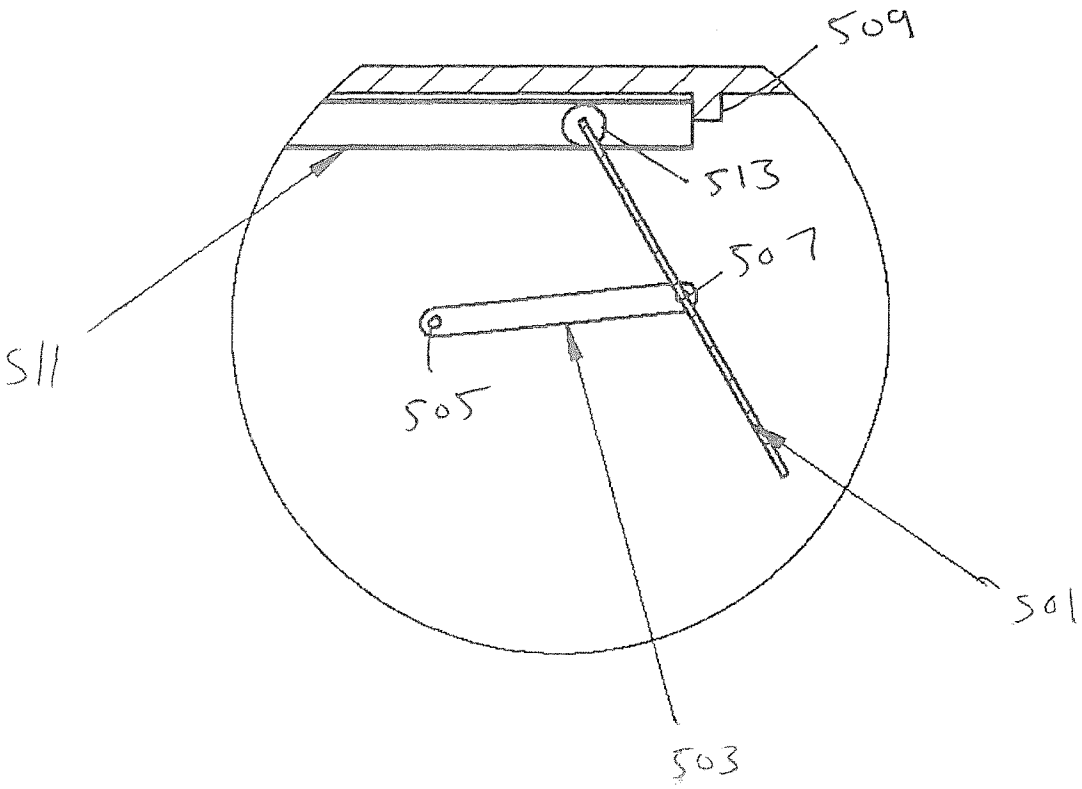
FIG. 8 shows the embodiment of FIG. 7 in a transition position.
Figure 9:
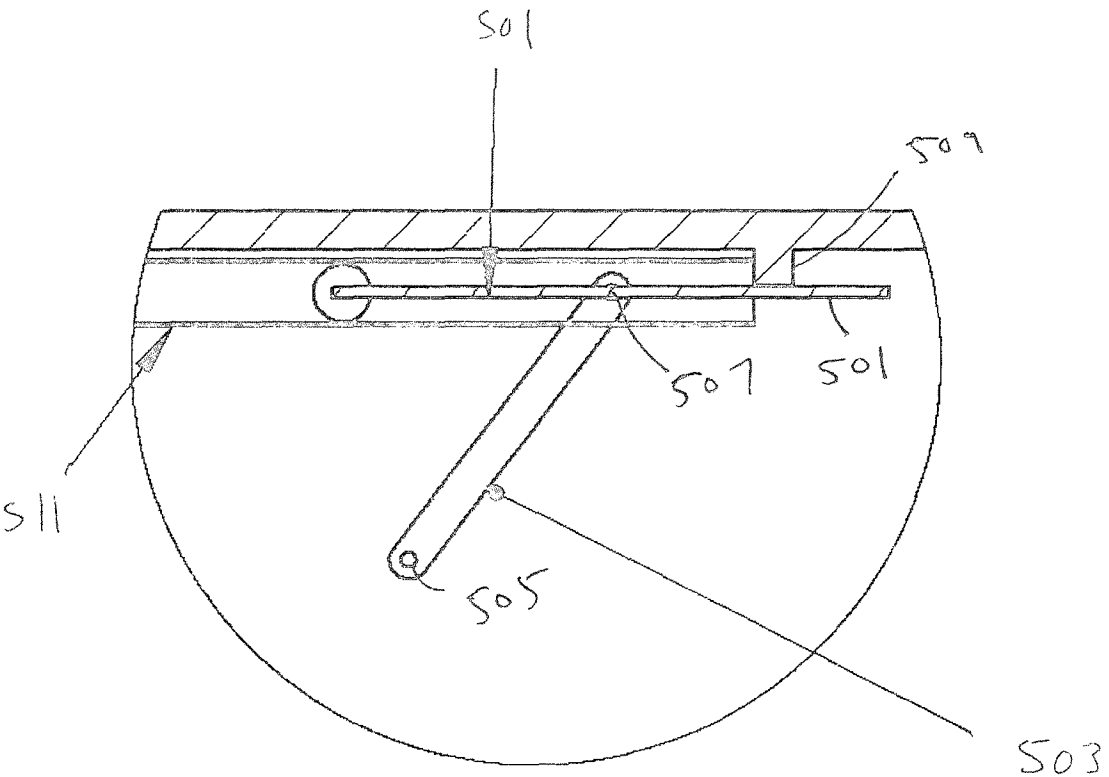
FIG. 9 shows the embodiment of FIG. 7 in an open position.

While it should be understood that the barriers (105) and (145) and/or doors (151) and (154) can utilize any structures known to one of ordinary skill in the art, FIGS. 7-9 provide for an exemplary embodiment showing the movement of a portion of a sample barrier (105) between chambers (101) and (103). However, this barrier (105) may be used between any combination of the chambers (101), (103), and (104) which share a wall. The barrier (500) of FIGS. 7-9 comprises a barrier panel (501). An elongated arm (503) is connected at one end by a pivot (505) to the inside surface of the chamber (101) and at the other end to a pivot (507) located generally toward the center of the barrier panel (501). A sealing edge (509) protrudes from the inside chamber surface, making contact with the barrier panel (501) when in the closed position as shown in FIG. 7. A track (511) is affixed to the internal chamber surface so that a wheel (513) which is attached toward one end of the barrier panel (501) may move along the track (513). As the wheel (513) travels along the track (511), the barrier panel (501) will angle from a closed position transverse to the chambers (101) and (103) as shown in FIG. 7, through the angled position of FIG. 8, ending in a longitudinal or open position as shown in FIG. 9. As should be apparent, the barrier (500) can be duplicated and reversed so as to allow two such barriers (500) to operate in conjunction as doors (151) jointly forming barrier (105) as shown in FIGS. 1, 3 and 6. In such an embodiment, there will generally be an additional sealing surface (519) located toward the opposing end of the barrier (500). If the barrier (105) comprises only a single barrier (500), a seal equivalent to edge (509) may be provided on the opposing inner chamber surface. Generally, each barrier panel (501) would also have a flange of flexible material around the perimeter, which would act as a gasket to provide a seal against the interior surface of the dishwasher (100) or (200).

Figure 10:
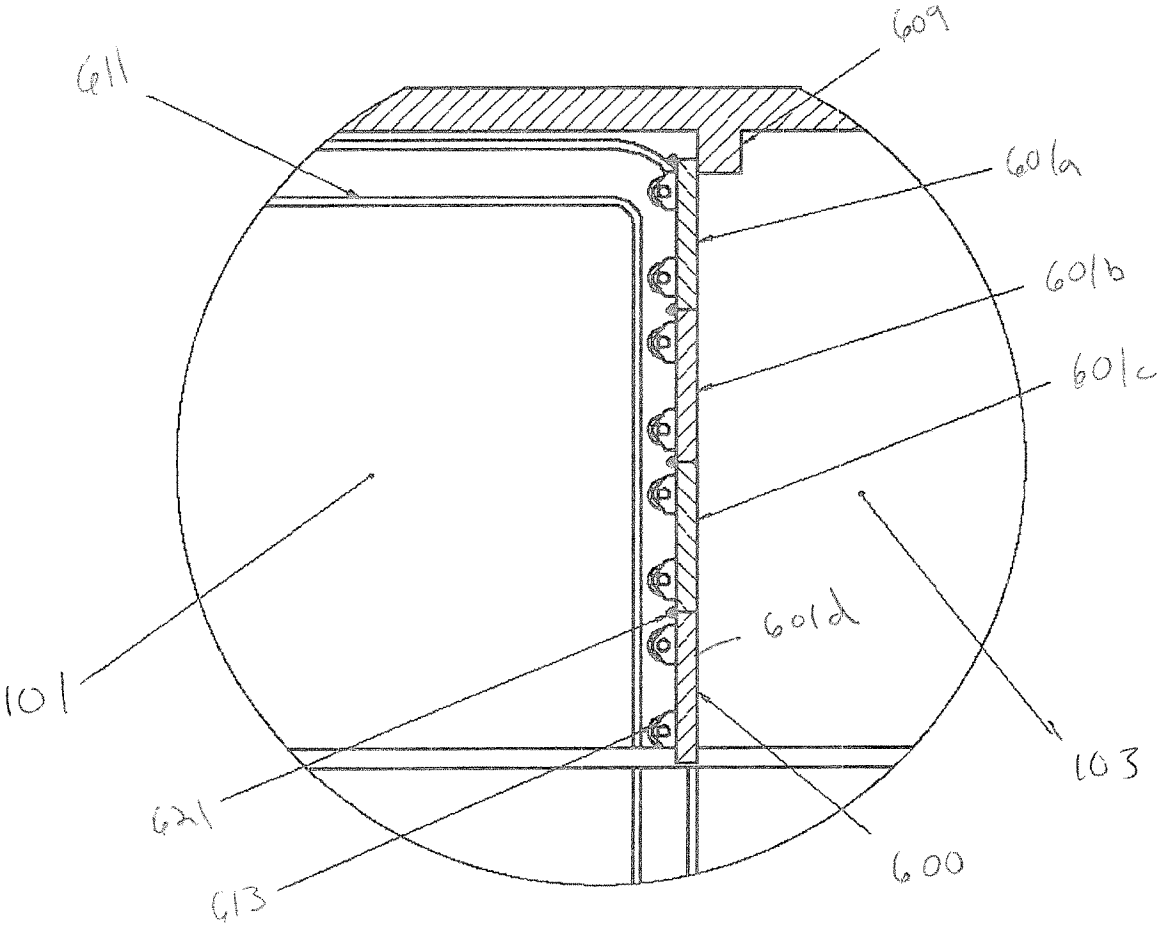
FIG. 10 shows a second embodiment of a barrier system in a closed position.
Figure 11:
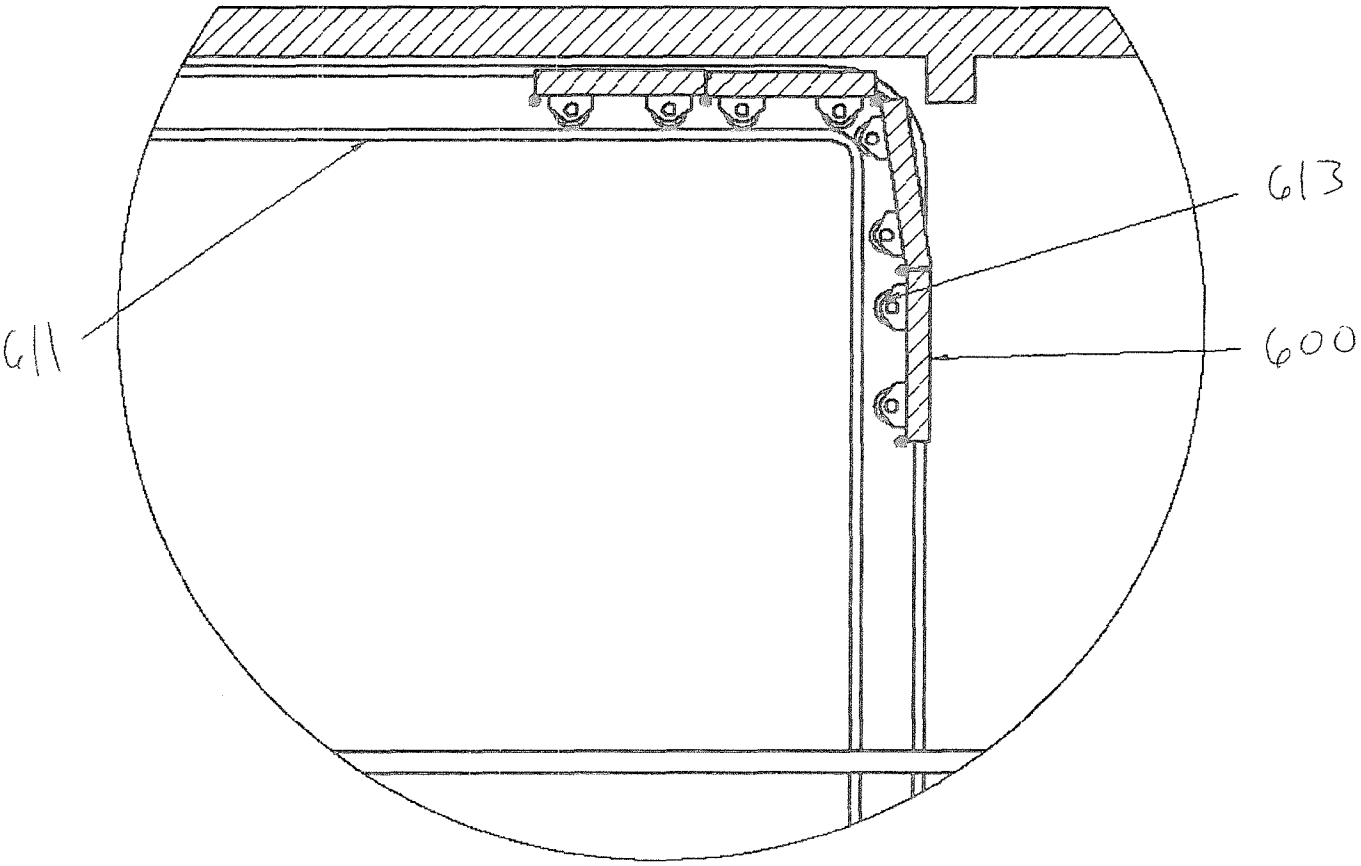
FIG. 11 shows the embodiment of FIG. 10 in a transition position.
Figure 12:
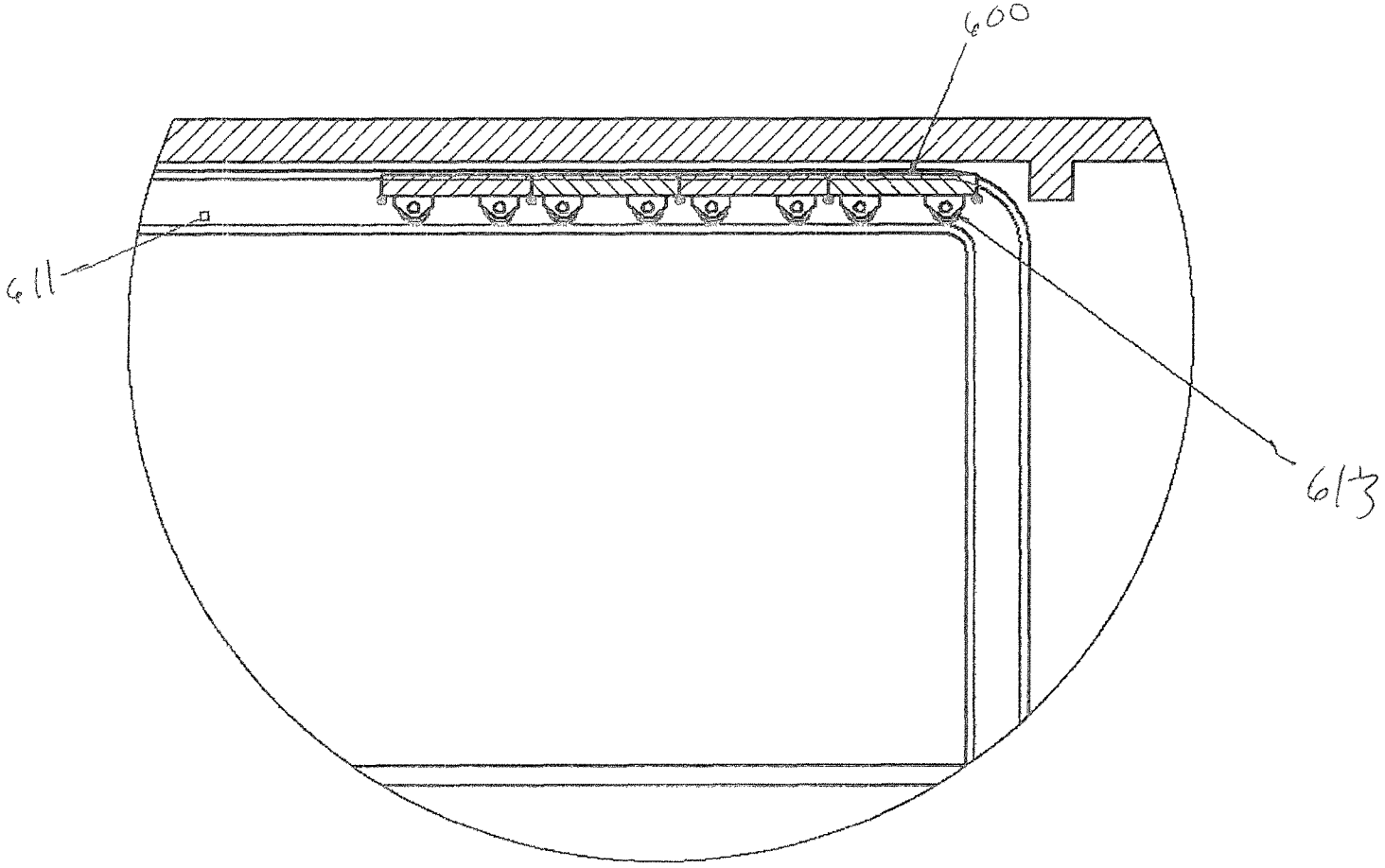
FIG. 12 shows the embodiment of FIG. 10 in an open position.

As should be apparent from the above, this type of barrier system (105) can work well as it allows for the barrier (105) to open and close in a fashion where the barrier panel (501) can clear a rack (107) regardless of which chamber (101) or (103) it is positioned in. However, it is not the only alternative. FIGS. 10-12 provide for an alternative barrier system. In this embodiment, water proof barrier panel (600) comprises a series of articulated panels (601*a*), (601*b*), (601*c*), and (601*d*) connected to a right-angle track (611) with rollers (613). Each panel (611) is connected to the panels (611) adjacent with a hinge mechanism (621). The panel (601*a*) closest to the chamber wall will seal against the chamber with a gasket (609) when the panels are in the closed position as shown in FIG. 10. As the rollers (613) move along the track (611), the barrier panels (601) move from a transverse position to a longitudinal position as shown in process in FIG. 11, until all of the barriers are in the longitudinal position and the barrier (600) is open as shown in FIG. 12.

Figure 15:
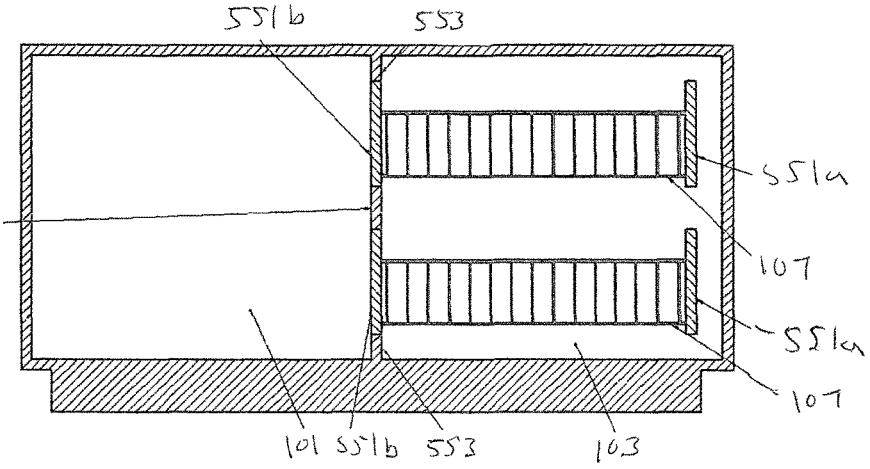
FIG. 15 shows the embodiment of FIG. 13 with the racks in the storage chamber.
Figure 14:
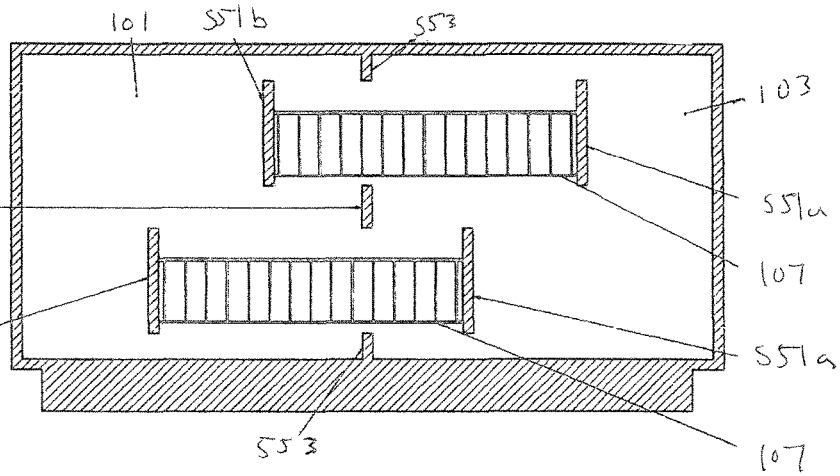
FIG. 14 shows the embodiment of FIG. 13 with the racks in transition.
Figure 13:
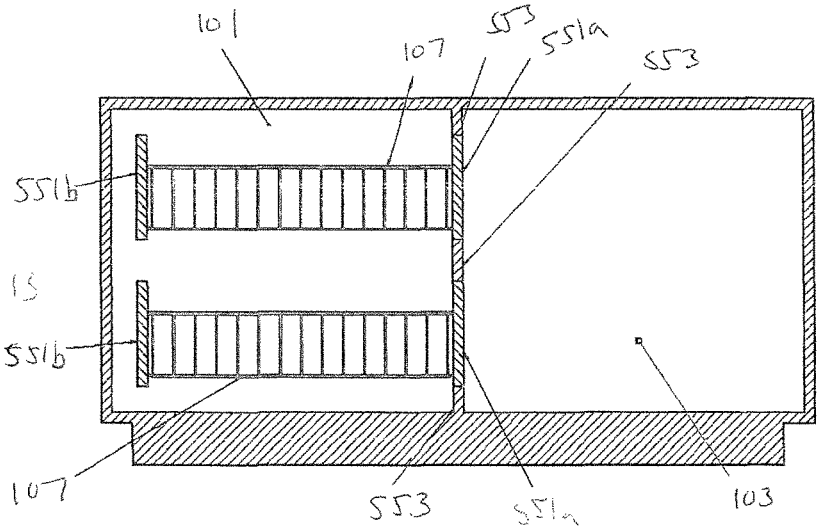
FIG. 13 shows front view of another embodiment of a two-chamber dishwasher. This embodiment utilizes barrier panels that move with the racks and is shown with the racks in the washing chamber.

FIG. 13-15 show a still further embodiment of a barrier system (105). In this embodiment, doors are not used. Instead, the barrier (105) comprises a plurality of sealing panels (551) mounted to the racks (107). The barrier panels (551) create a water-resistant seal against stable surfaces (553) separating the dishwasher chambers (101) and (103) when in either extreme position. Specifically, a first barrier panel (551*a*) will form seals with internal surfaces (553) when the racks are inside the washing chamber (101) and the barrier panels (553) are simply placed internal to the chamber (101) as shown in FIG. 13. When the rack moves between the chambers, these panels (551*a*) separate and move into the chamber (103) while the panels (551*b*) move within the chamber (101) as shown in FIG. 14. Once the rack (107) is fully within the storage chamber (103), the barriers (551*b*) are able to seal with the surfaces (553) as shown in FIG. 15.

In order to move the racks (107) between the chambers (101), (103) and (104), a variety of mechanisms (123) can be used as shown in FIGS. 16-21. Like in the case of the barrier (105), these are provided merely as exemplary embodiments and others may be used as would be understood by pone of ordinary skill in the art.

Figure 16:
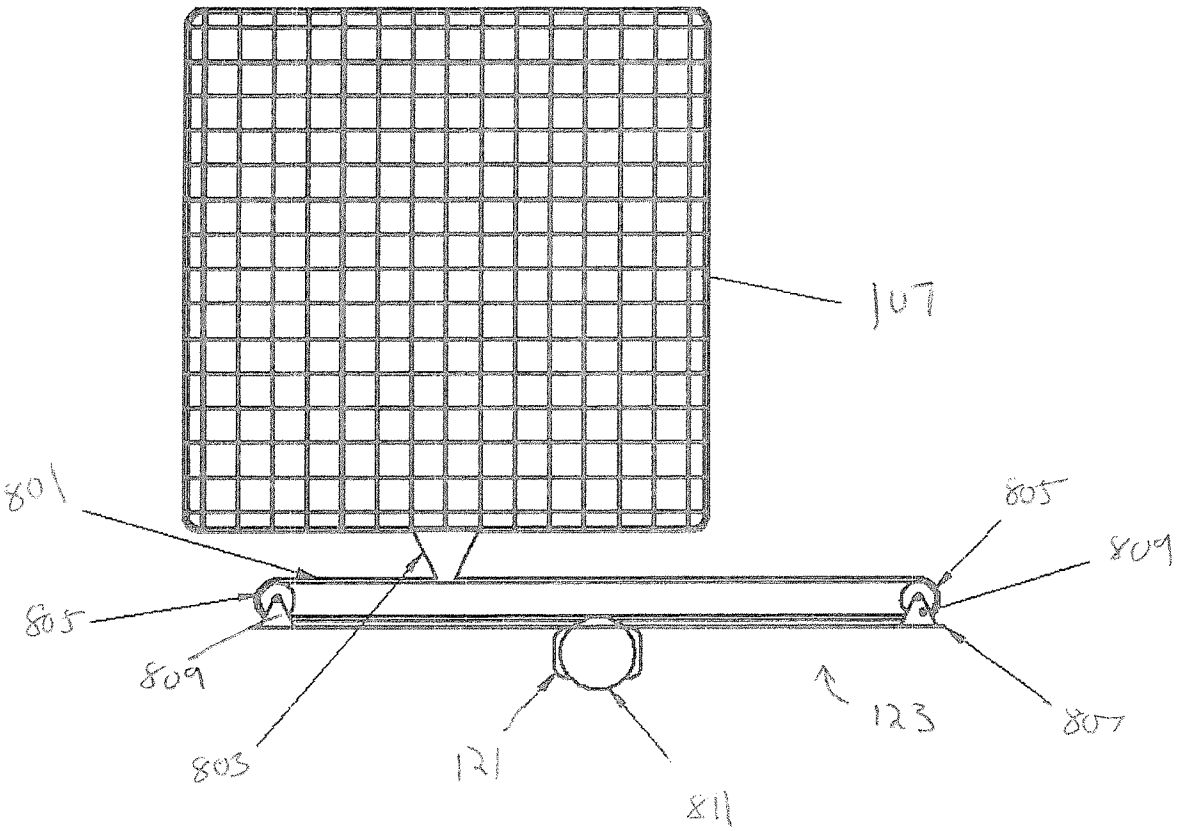
FIG. 16 shows an embodiment of a conveyance mechanism utilizing a chain drive.

In the embodiment of FIG. 16 there is provided a conveyance mechanism (123) comprising a cable drive (801) is given as an example. The rack (107) is connected to a drive cable (801) by means of a bracket (803). The cable (801) is supported by two idle pulleys (805) which are connected to the interior surface (807) of the dishwasher (100) or (200) (generally spanning the two chambers (101) and (103)) by means of brackets (809). The cable wraps around a drive pulley (811) which is connected to an electric motor (121) which is in turn connected to a power source in the standard fashion.

Figure 17:
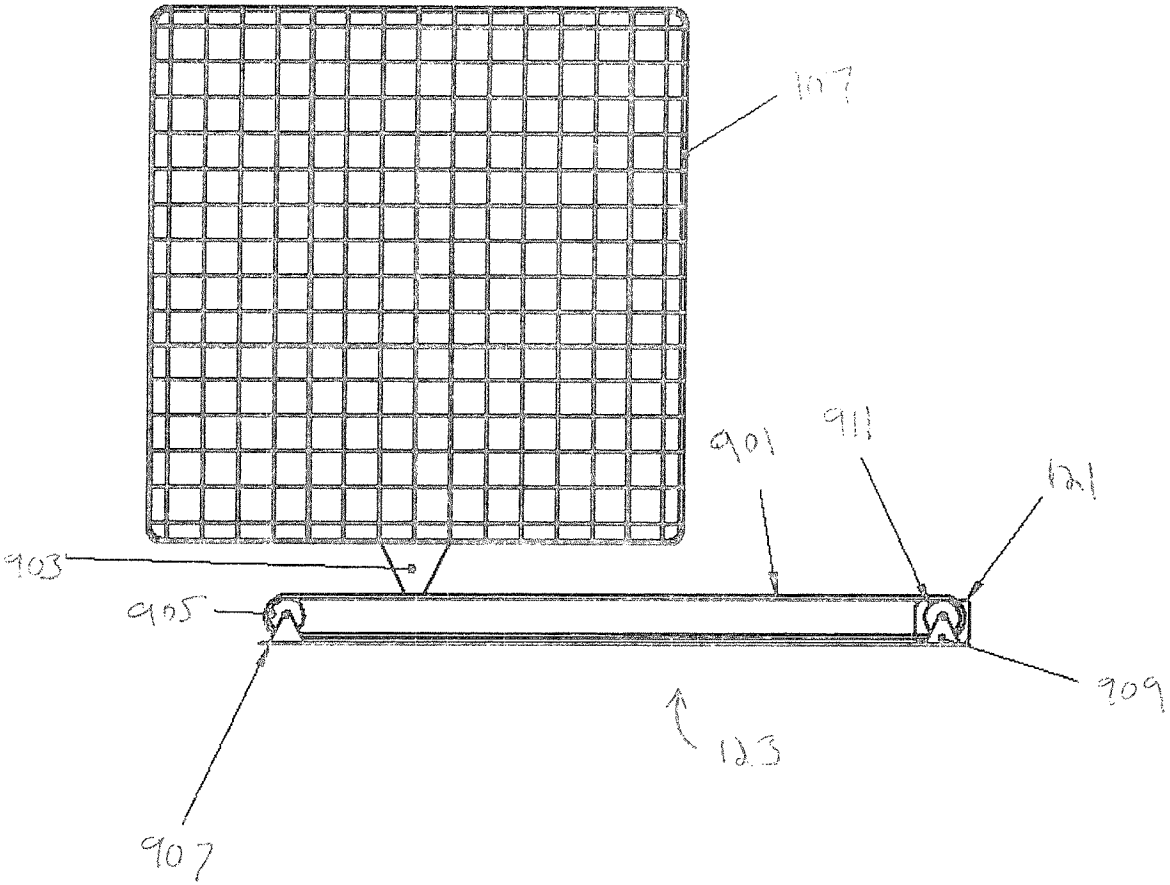
FIG. 17 shows an embodiment of a conveyance mechanism utilizing a drive pulley.

In the embodiment of FIG. 17 a belt or rolling chain drive (901) is provided as mechanism (123). As in FIG. 6, the rack (107) is connected to a belt or roller chain (901) by means of a bracket (903). The belt (901) is supported by an idle pulley (905) which is connected to the surface of the inner surface wall (907) of the dishwasher (100) or (200) by means of brackets (909). The belt wraps around a drive pulley (911) which is connected to an electric motor (121). This embodiment is the conveyor mechanism (123) which is depicted in the embodiment of dishwasher (100) provided in FIGS. 1-4.

Figure 18:
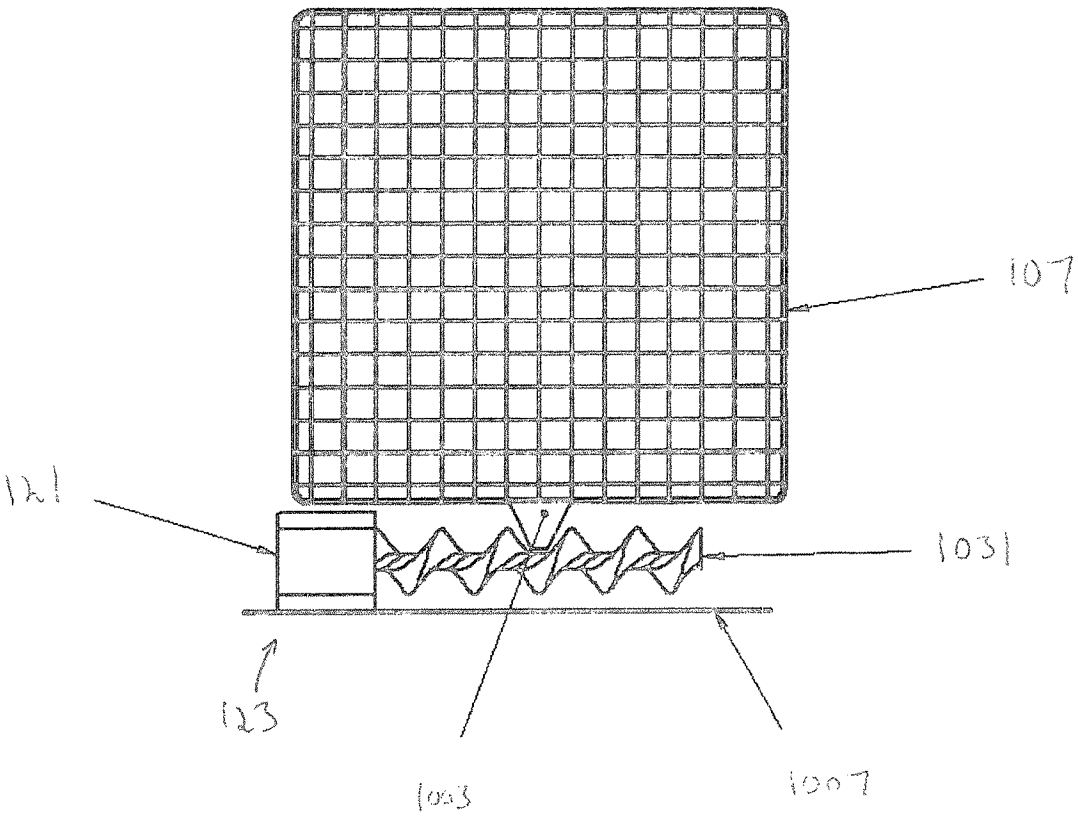
FIG. 18 shows an embodiment of a conveyance mechanism utilizing a worm drive.

In the embodiment of FIG. 18 the conveyance mechanism (123) makes use of a motor (121) which is mounted to the inner surface of the dishwasher (1007). The motor (121) turns a screw or worm drive (1031) which in turn engages with bracket (1003) mounted on the rack (107). As the screw drive (1031) turns, the rack (107) is conveyed longitudinally.

Figure 21:
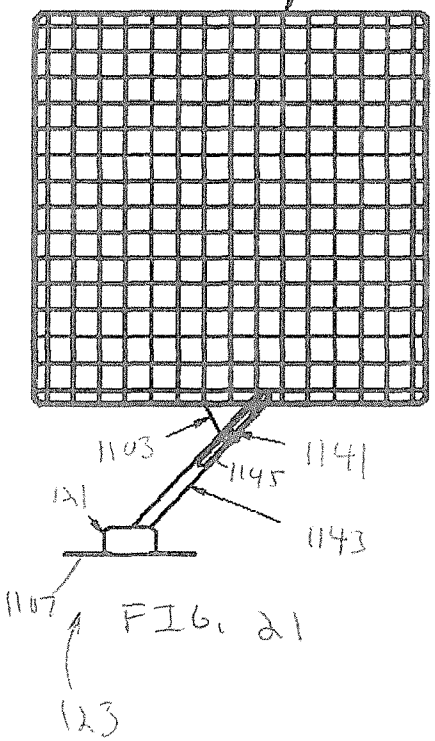
FIG. 21 shows the embodiment of FIG. 19 with the rack in the other chamber.
Figure 20:
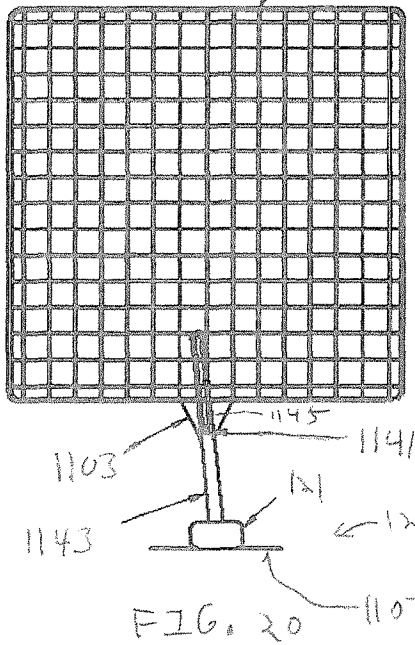
FIG. 20 shows the embodiment of FIG. 19 with the rack in transition between chambers.
Figure 19:
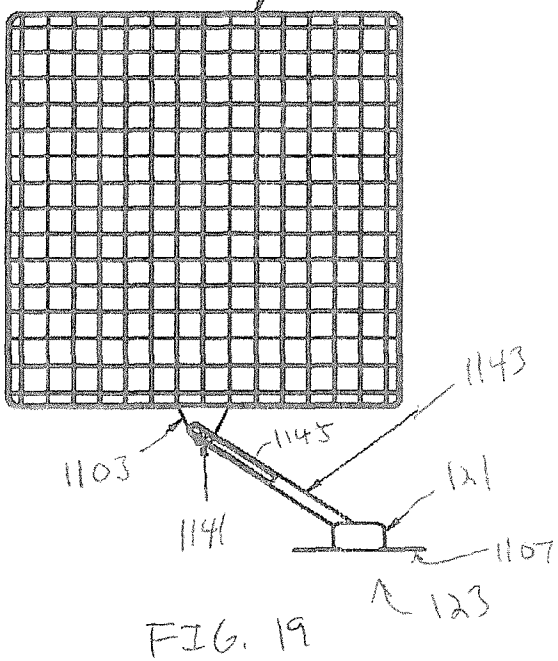
FIG. 19 shows an embodiment of a conveyance mechanism utilizing a lever arm with the rack located in one chamber.

FIGS. 19-21 provide for a conveyance mechanism (123) where the rack (107) is conveyed between chambers (101), (103), and (104) by means of a slotted lever arm (1143). One end of the lever arm (1143) is connected to a motor and gear box (121) which are connected to the inside surface (1107) of the dishwasher (100) or (200) and which causes the lever arm (1143) to rotate. The rack (107) has a post (1141) mounted on a bracket (1103) which engages a slot (1145) on the lever arm (1143). When the lever arm (1143) rotates, the rack (107) slides longitudinally between chambers (101), (103) and/or (104).

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A dishwasher comprising:

a washing chamber including a washing chamber door which totally seals an opening into said washing chamber;

a storage chamber separated from said washing chamber by a waterproof barrier and including a storage chamber door which totally seals an opening into said storage chamber;

a rack configured to support dishes; and a means for conveying said rack between said washing chamber and said storage chamber through said waterproof barrier;

wherein when said washing chamber door is open, said rack can be accessed by a user through said opening into said washing chamber if said rack is in said washing chamber; and wherein said washing chamber is configured to wash and dry dishes in said rack when said rack is within said washing chamber;

wherein, after said dishes have been washed and dried in said washing chamber, said waterproof barrier is automatically opened and said means automatically moves said rack through said waterproof barrier and into said storage chamber; and wherein when said storage chamber door is open, said rack can be accessed by said user through said opening into said storage chamber if said rack is in said storage chamber.

2. The dishwasher of claim 1, further comprising:

a pre-wash chamber separated from said washing chamber by a second waterproof barrier;

wherein said rack can be accessed by said user if said rack is in said pre-wash chamber.

3. The dishwasher of claim 2, wherein said means for conveying is configured to move said rack, in order, from said pre-wash chamber, to said washing chamber, to said storage chamber.

4. The dishwasher of claim 2, wherein said means for conveying is configured to move, in order, from said pre-wash chamber, to said washing chamber, to said pre-wash chamber; or said conveying means is configured to move, in order, from said storage chamber, to said washing chamber, to said storage chamber.

5. The dishwasher of claim 1 wherein said means for conveying comprises a chain drive.

6. The dishwasher of claim 1 wherein said means for conveying comprises a belt drive.

7. The dishwasher of claim 1 wherein said means for conveying comprises a worm drive.

8. The dishwasher of claim 1 wherein said means for conveying comprises a lever arm.

9. The dishwasher of claim 8 wherein a first end of said lever arm is connected to an inside surface of said dishwasher and said lever arm rotates around said first end to move said rack.

10. The dishwasher of claim 1, wherein said waterproof barrier comprises a plurality of articulated panels.

11. The dishwasher of claim 10, said plurality of articulated panels are connected to a right-angle track.

12. The dishwasher of claim 11, wherein said plurality of articulated panels are movable on said right-angle track by rollers.

13. The dishwasher of claim 1 wherein said means for conveying moves said rack alternately from said washing chamber to said storage chamber and back to said washing chamber.

* * * * *